US008710945B2

(12) United States Patent
Wygnanski

(10) Patent No.: US 8,710,945 B2
(45) Date of Patent: Apr. 29, 2014

(54) MULTISTABLE ELECTROMAGNETIC ACTUATORS

(75) Inventor: Wladyslaw Wygnanski, Cambridge (GB)

(73) Assignee: Camcon Oil Limited, Cambridge (GB)

( * ) Notice: Subject to any disclaimer, the term of this patent is extended or adjusted under 35 U.S.C. 154(b) by 158 days.

(21) Appl. No.: 13/129,134

(22) PCT Filed: Dec. 8, 2009

(86) PCT No.: PCT/GB2009/051668

§ 371 (c)(1),
(2), (4) Date: Jun. 28, 2011

(87) PCT Pub. No.: WO2010/067110

PCT Pub. Date: Jun. 17, 2010

(65) Prior Publication Data

US 2011/0248804 A1 Oct. 13, 2011

(30) Foreign Application Priority Data

Dec. 13, 2008 (GB) ..... 0822760.5
Oct. 23, 2009 (GB) ..... 0918632.1

(51) Int. Cl.
*H01F 7/00* (2006.01)

(52) U.S. Cl.
USPC ..... 335/229; 335/234

(58) Field of Classification Search
USPC ..... 335/229, 230, 234; 251/129.15
See application file for complete search history.

(56) References Cited

U.S. PATENT DOCUMENTS 3,119,940 A * 1/1964 Pettit et al. ..... 310/24
3,149,255 A * 9/1964 Trench ..... 310/30
3,202,886 A * 8/1965 Kramer ..... 335/234

(Continued)

FOREIGN PATENT DOCUMENTS

DE 10 2008 000534 A1 9/2009
EP 1119723 A1 8/2001

(Continued)

OTHER PUBLICATIONS

International Search Report and Written Opinion for corresponding International Application No. PCT/GB2009/051668, dated Mar. 26, 2010.

(Continued)

*Primary Examiner* — Alexander Talpalatski
(74) *Attorney, Agent, or Firm* — Marshall, Gerstein & Borun LLP

(57) ABSTRACT

A multistable electromagnetic actuator is provided which addresses a need for a more robust, reliable and energy efficient actuation device. It comprises an armature (10) having a permanent magnet (8), wherein the armature is movable between first and second stable positions, and two electric coils (14*a*,14*b*) disposed on opposing sides of the armature along its direction of movement, with their axes substantially aligned with said direction. A magnetic flux container (2) substantially surrounds the armature and the coils to contain magnetic flux generated thereby and to shield its interior from external magnetic flux. In each stable position magnetic flux generated by the permanent magnet (8) extends around a magnetic circuit path including the container so as to retain the armature in its stable position. Energising the coils (14*a*, 14*b*) causes the armature (10) to move from one stable position to the other. It is suitable for a broad range of applications, including fluid flow control for example.

10 Claims, 7 Drawing Sheets

(56) References Cited

U.S. PATENT DOCUMENTS

| | | | | | |
|---|---|---|---|---|---|
| 3,504,315 | A | | 3/1970 | Stanwell | |
| 3,772,540 | A | | 11/1973 | Benson | |
| 3,980,908 | A | | 9/1976 | McClintock | |
| 4,422,060 | A | * | 12/1983 | Matsumoto et al. | 335/256 |
| 4,533,890 | A | | 8/1985 | Patel | |
| 4,751,487 | A | * | 6/1988 | Green, Jr. | 335/234 |
| 4,774,485 | A | | 9/1988 | Dietrich | |
| 4,829,947 | A | * | 5/1989 | Lequesne | 123/90.11 |
| 4,928,028 | A | | 5/1990 | Leibovich | |
| 4,930,464 | A | * | 6/1990 | Letsche | 123/90.12 |
| 5,434,549 | A | * | 7/1995 | Hirabayashi et al. | 335/229 |
| 5,896,076 | A | * | 4/1999 | van Namen | 335/229 |
| 6,028,499 | A | * | 2/2000 | Oudet et al. | 335/220 |
| 6,819,208 | B1 | | 11/2004 | Peghaire et al. | |
| 2005/0184842 | A1 | * | 8/2005 | Reynolds et al. | 335/229 |
| 2011/0001591 | A1 | | 1/2011 | Puth et al. | |

FOREIGN PATENT DOCUMENTS

| | | | |
|---|---|---|---|
| GB | 0958501 | A | 5/1964 |
| GB | 1196418 | A | 6/1970 |
| GB | 2228831 | A | 9/1990 |
| GB | 2450681 | A | 1/2009 |
| JP | 5-15407 | | 2/1993 |
| JP | 5-029133 | | 2/1993 |
| JP | 2004253418 | A | 9/2004 |
| WO | WO-2009/109444 | A1 | 9/2009 |

OTHER PUBLICATIONS

United Kingdom Intellectual Property Office Search Report from corresponding application No. GB0822760.5, dated Jun. 10, 2009.

United Kingdom Intellectual Property Office Search Report from corresponding application No. GB0918632.1, dated Mar. 10, 2010.

* cited by examiner

MULTISTABLE ELECTROMAGNETIC ACTUATORS

CROSS-REFERENCE TO RELATED APPLICATIONS

This is the U.S. national phase of International Application No. PCT/GB2009/051668, filed Dec. 8, 2009, which claims the benefit of United Kingdom Patent Application No. 0822760.5, filed Dec. 13, 2008 and United Kingdom Patent Application No. 0918632.1, filed Oct. 23, 2009.

FIELD OF THE INVENTION

The present invention relates to multistable electromagnetic actuators and more particularly actuators suitable for controlling fluid flow.

BACKGROUND TO THE INVENTION

Spring-loaded solenoid-based actuators are often employed to control locks or the flow of fluids, for example. However, they are typically monostable devices and require a continuous current to maintain the driving rod of the device in its actuated position. This leads to unwanted energy dissipation in the form of heat.

EP-A-1119723 (filed by the present applicant under reference 554.02/W) describes a magnetic drive having a bistable characteristic, which can be configured to revert to (or remain in) one of its two states in the event of a power failure.

U.S. Pat. No. 3,772,540 relates to an electromechanical latching actuator for producing linear or rotary motion. FIGS. 1A to 1D depict an actuator which includes one or more sets of radially polarised permanent magnets and electric coils which annul and flux switch a magnetic field between adjacent magnetically isolated poles, thereby sequentially generating a force or torque that can be coupled to a suitable load. However, its performance may be affected by magnetic fields present in its surrounding environment.

The present invention seeks to provide a robust and reliable electromagnetic actuator configuration, suitable for use in a broad range of applications.

The present invention provides an electromagnetic actuator comprising an armature comprising a permanent magnet, wherein the armature is movable between first and second stable positions; two electric coils disposed on opposing sides of the armature along its direction of movement, with their axes substantially aligned with said direction; and a magnetic flux container substantially surrounding the armature and the coils to substantially contain magnetic flux generated thereby and to substantially shield its interior from external magnetic flux, wherein in each stable position magnetic flux generated by the permanent magnet extends around a magnetic circuit path including the container so as to retain the armature in its stable position, and wherein energising the coils causes the armature to move from one stable position to the other.

The known actuator configurations acknowledged above have open flux arrangements wherein the permanent magnets create flux which extends outside the actuators themselves. Therefore their performance is susceptible to external influences. For example, it may be influenced by magnetic surrounding components such as another actuator or a ferromagnetic housing. In addition, an open magnetic field attracts ferromagnetic particles from the environment. A fluid or gas flowing close to the actuator may include small ferromagnetic particles, for example as the result of corrosion. Aggregation of such particles risks causing a blockage. This is undesirable in many applications, particularly critical roles in jet engine fuel flow control or the space industry for example.

The magnetic flux container present in an actuator according to the invention extends around the armature and electric coils in such a way as to substantially contain within it the magnetic flux generated by these elements, thereby minimising any side effects resulting from flux leakage. Magnetic circuits formed during operation of the device are closed by the container.

Furthermore, the container serves to shield the interior of the actuator from external magnetic fields. The actuator is substantially sealed against the ingress of magnetic flux from outside by the container.

Preferably, each coil is wound round a coil core which forms part of the magnetic circuit created when the armature is adjacent to the respective coil. More particularly, the actuator may be configured such that, when the armature is in either of the stable positions, the shortest path from the armature to the container is less than the shortest path from the armature to the more distant of the two coil cores. This ensures that the armature is reliably latched against one of the coil cores in each stable rest position.

The armature may include pole pieces on opposing sides of the permanent magnet along its direction of movement. The actuator is preferably configured such that, when the coils are energised, the path of magnetic flux through the pole piece closest to the corresponding coil core changes from a substantially axial orientation to a substantially radial orientation, and vice versa for the other pole piece.

In preferred embodiments, each pole piece defines a surface for engagement with a respective coil core, and each coil core defines a complementary engagement surface.

In particular, each of said pole piece engagement surfaces may include a frustoconical portion. This serves to create a more uniform force of attraction characteristic between the two mating surfaces, relative to planar faces.

In a preferred implementation, the permanent magnet is orientated with its North and South poles aligned with the direction of movement of the armature. Relative to radial alignment of the poles, a significantly greater locking force is achieved as a greater area of high flux density faces the adjacent coil core.

Actuators embodying the invention preferably include an energy storage arrangement for storing energy derived from movement of the armature into each stable position. This storage arrangement transfers energy to the armature as it moves away from each stable position. This provides internal energy recycling and so reduces the power required to switch the device. It also affords a "soft landing" effect, which will extend the lifetime of the actuator. Also, in applications where the actuator controls fluid flow by pinching a deformable tube, the deceleration caused by the energy storage arrangement as the actuator moves towards each stable position reduces the likelihood of damage to the tube.

The extent of the energy storage may be readily adjusted as appropriate to alter the net latching force exerted on the armature to suit different applications.

The energy storage arrangement may comprise a pair of resilient devices, such as coil springs for example, with one of the devices being compressed or extended as the armature moves into a respective stable position. The resilience of these devices may be selected to suit a particular requirement.

Each resilient device may be disposed between a pole piece and a respective coil core, providing a compact and self-contained configuration. Alternatively, the resilient devices may be located outside the housing of the actuator to provide a greater area of engagement between the armature and the coil cores, thereby increasing the latching force. Also, larger resilient devices may be more readily accommodated outside the actuator housing in this implementation.

In some embodiments, either resilient device is only compressed or extended as the armature moves through a final portion of its travel into a respective stable position.

In a further embodiment of the invention, the actuator has a third stable position between the first and second stable positions. This third position is preferably defined by spring and passive magnetic forces acting on the armature.

A pair of resilient devices may be arranged such that one of them is compressed (or extended) or compressed (or extended) further if the armature moves away from the third stable position, so as to urge the armature towards the third stable position.

Preferably, each resilient device is partially compressed (or extended) when the armature is in the third stable position. This pre-loading of each resilient device makes the third stable position more definite and more clearly defined and readily selectable.

The extent to which each resilient device may be partially compressed (or extended) when the armature is in the third stable position may be adjustable so as to emphasise the third position to the degree needed to meet particular requirements.

According to a further preferred configuration, an actuator may be arranged such that when the armature moves from the third stable position to one of the first and second stable positions so as to compress (or extend) further one of the resilient devices, at least during a final portion of said movement (preferably substantially the whole of said movement), the degree of partial compression (or extension) of the other resilient device remains substantially unchanged. This has the effect that during movement of the armature from the third stable position to another stable position and back again, energy is not expended in deformation of the other resilient device and it does not therefore influence this action of the actuator.

Conveniently, the magnetic flux container may form the housing of the actuator.

According to a further aspect, the present invention provides a method of operating an actuator as described herein, comprising the step of moving the armature from one stable position to the other by energising the coils so as to generate axial magnetic flux through each coil in respective opposite directions. As will be described with reference to embodiments of the invention below, applying a current pulse momentarily to each coil in this manner serves to substantially nullify the flux created by the permanent magnet on one side whilst augmenting the flux density on the other side, causing the armature to switch positions.

The armature is held in each stable rest position by spring and/or passive magnetic forces alone, with only a brief current pulse needed as and when the actuator is switched to a different stable rest position. Its power consumption is therefore very low.

BRIEF DESCRIPTION OF THE DRAWINGS

Embodiments of the invention will now be described by way of example and with reference to the accompanying schematic drawings, wherein.

DETAILED DESCRIPTION OF THE DRAWINGS

Figure 1:
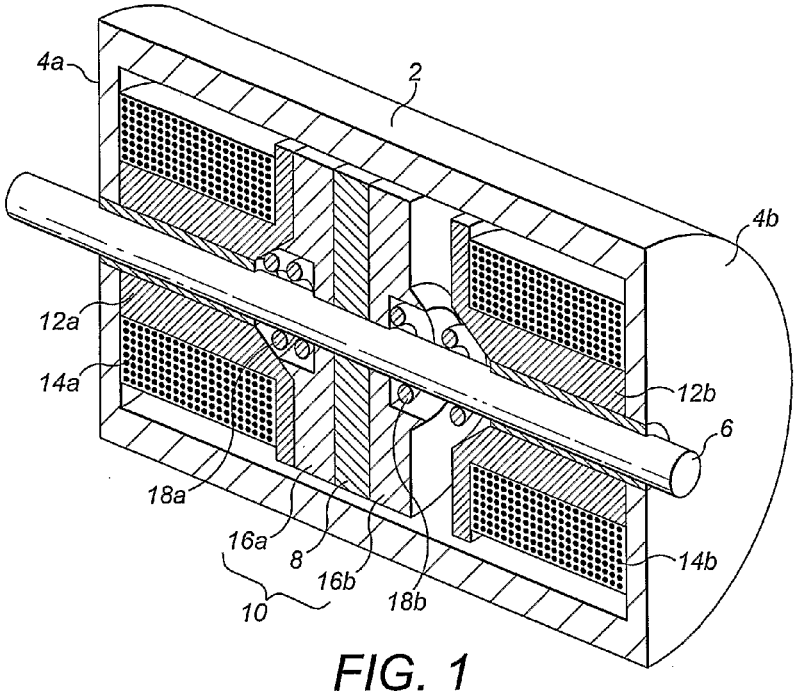
FIGS. 1 and 2 are perspective and side cross-sectional views, respectively, of actuators embodying the invention.

The same reference numerals are generally used for identical or similar parts, even if a repeated description is omitted. In particular, identical or corresponding advantages and properties may be provided.

Figure 2:
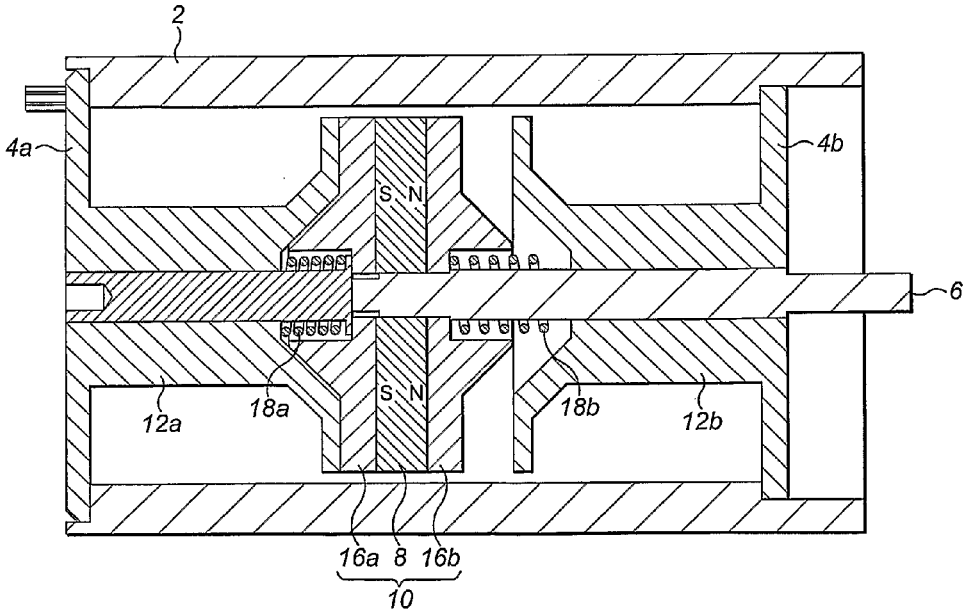

FIGS. 1 and 2 show cross-sectional views of an actuator embodying the invention. It is a fully magnetically sealed bistable push-pull actuator including an internal energy recycling mechanism. It is suitable for use as a directly linked mechanical driver, or to operate a valve or electric switch. It could be used as a direct replacement for traditional solenoid-based actuators, with a substantial reduction in power consumption.

The actuator includes a magnetic flux container or cage 2 which also forms the actuator housing. Each end of the container is closed by end caps 4*a* and 4*b*. A driving element in the form of a push-pull rod 6 extends along the longitudinal axis of the actuator. In the embodiment of FIG. 1, this rod extends through and beyond both end caps, whilst in the arrangement of FIG. 2, it only protrudes from one end of the actuator.

A permanent magnet 8 is mounted on a central portion of the rod 6. Pole pieces 16*a* and 16*b*, also mounted on the rod, are provided in contact with and on either side of the permanent magnet 8. The magnet and pole pieces together form an armature 10.

Facing each pole piece in the axial direction are coil cores 12*a* and 12*b*. A coil 14*a*, 14*b* is provided around each coil core in axial alignment with the rod 6. (The coils are not shown in the embodiment of FIG. 2).

Coil springs 18*a* and 18*b* are provided around rod 6 on either side of the armature 10. The springs may be configured such that they are in contact with the corresponding pole piece and coil core at all times, so that one of them begins to be compressed as soon as the armature moves away from one of its stable positions. Alternatively, compression of one of the springs may only begin part way through the travel of the armature into one of its stable positions to facilitate faster initial travel of the armature. This may be achieved by providing springs which are shorter in their uncompressed state than the maximum spacing between each pole piece and the corresponding coil core.

A position sensor (not shown), such as a Hall sensor, may be located adjacent one of the stable positions of the actuator to provide a signal indicative of the armature location.

In the embodiment of FIG. 2, it can be seen that the coil cores 12*a*,12*b* are integrally formed with the end caps 4*a*,4*b*. It will be appreciated that the magnetic flux container or cage may be provided by a number of discrete elements coupled together. It can be seen that in the embodiments of FIGS. 1 and 2 the container forms a continuous magnetic path which substantially externally surrounds the coils and permanent magnet. Preferably, the container is formed of a material having a high magnetic permeability, such as steel for example.

It may be advantageous to divide the pole pieces into two or more portions to reduce the generation of eddy currents, and the associated energy consumption and heating effects. To this end, the pole pieces may be formed of laminated material for example. Soft ferrites may be used to form the pole pieces.

In preferred embodiments there is direct contact between a pole piece and the corresponding coil core in each stable position to maximise the attractive magnetic forces therebetween.

The voids within the actuator may be filled with an inert liquid such as oil. It may be preferable to employ a gas instead as a relatively high viscosity fluid will tend to lead to a greater amount of energy being required to switch the actuator.

It will be appreciated that the actuator may be constructed in a range of sizes. Merely by way of example, an embodiment suitable for small scale applications has a length of 28 mm and a diameter of 19 mm.

Figure 3:
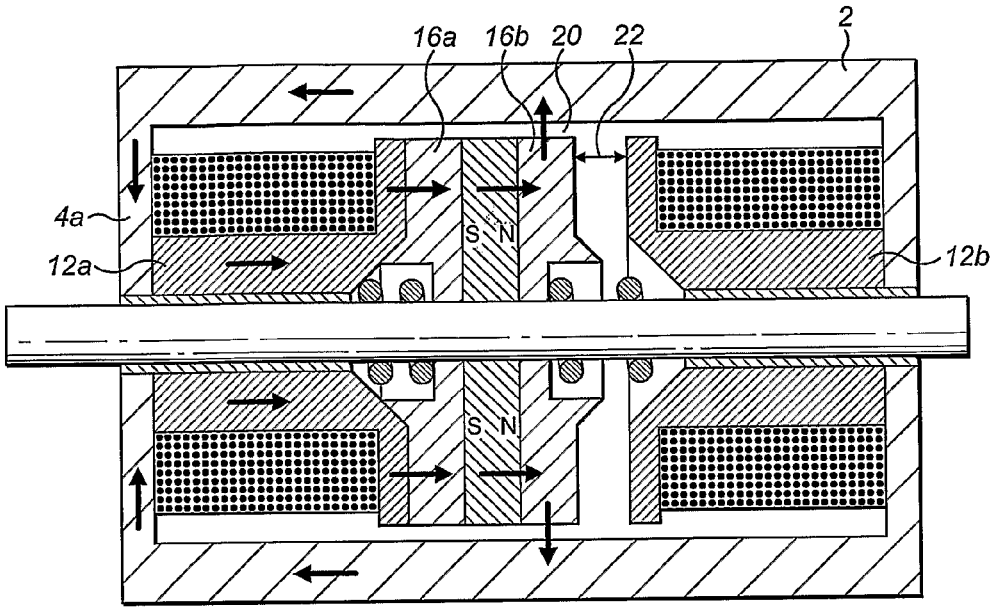
FIGS. 3 and 4 are side cross-sectional views of the actuator of FIG. 1 which illustrate its switching action.

The operation of an actuator embodying the invention will now be described with reference to FIGS. 3 and 4. FIG. 3 shows an actuator with the armature latched in one of its two stable positions. The path of flux lines emanating from the permanent magnet is shown by black arrows. The lines of flux travel from the North pole of permanent magnet 8 into right-hand pole piece 16*b*. The flux lines then extend radially outwards across the relatively small gap 20 between the pole piece and the container 2. They follow a path within the container 2 extending axially along the outer circumferential wall of the container and then radially inwards via end cap 4*a*. The path continues on axially inwards through coil core 12*a*, across the interface between the core and the adjacent pole piece 16*a*, before returning back to the permanent magnet 8.

The left-hand coil core 12*a* engages a complementary mating face of the adjacent pole piece 16*a*, with the lines of magnetic flux therebetween parallel to the push-pull rod 6. The right-hand pole piece 16*b* is attracted to the adjacent magnetic container and the flux lines between them are perpendicular to the axis of the push-pull rod. This is because the spacing 20 between the pole piece 16*b* and the container 2 is significantly smaller than the distance 22 between the pole piece and the corresponding face of the opposing coil core 12*b*. Accordingly, the net magnetic locking force exerted on the armature 10 is axially directed towards the left-hand coil core 12*a*.

Switching of the actuator will now be described with reference to FIG. 4. Movement of the armature from one stable position to the other is initiated by applying a current pulse to each of the coils 14*a*,14*b* so as to generate magnet flux through the centre of each coil in the respective opposite directions indicated by the arrows drawn in outline in FIG. 4. This additional flux acts to substantially nullify the flux generated by the permanent magnet through the coil core 12*a*. Furthermore, the flux generated by the magnet is forced to change direction from a parallel flow between the coil core 12*a* and the pole piece 16*a* to a radial orientation along a path extending from the container 2 into the pole piece 16*a*. As a result, the magnetic locking force is substantially reduced.

At the same time, the other coil 14*b* generates flux in the same direction as the flux from the permanent magnet. The lines of flux previously running radially outwards from pole piece 16*b* to the magnetic container 2 are now attracted instead towards coil core 12*b* and re-orientated into an axial direction extending in-between pole piece 16*b* and coil core 12*b*.

As a result, the net magnetic locking force exerted on the armature 10 is directed towards coil core 12*b*. The compressed spring 18*a* is no longer held by the locking force of the actuator and catapults the armature 10 away from coil core 12*a*, towards the other stable position.

Figure 4:
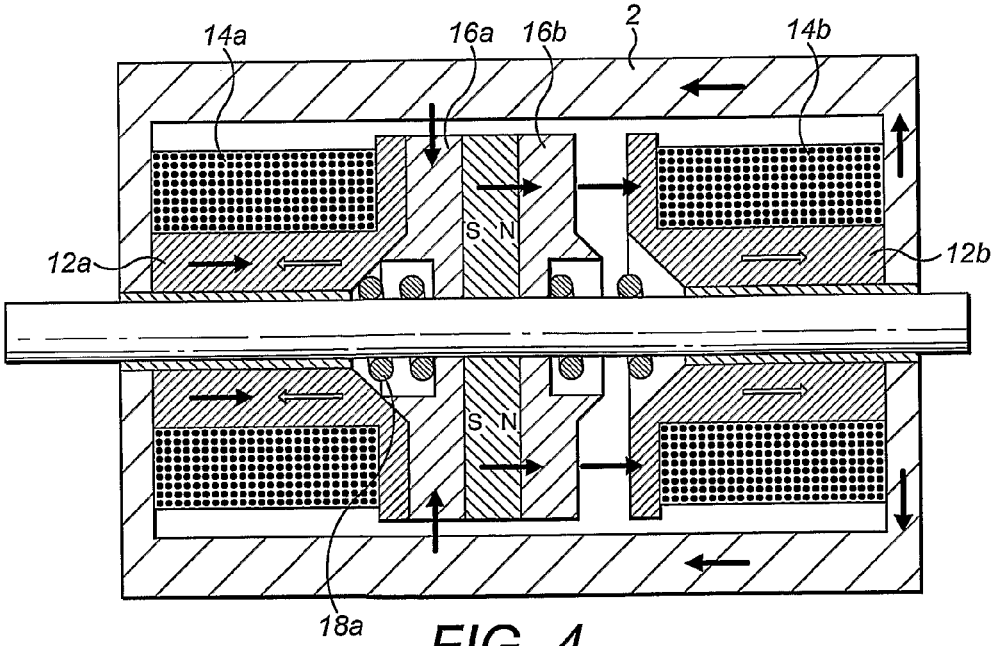

The coils 14*a* and 14*b* are arranged in a mirrored configuration such that a current pulse flowing outwardly along each coil from the inner ends thereof generates the opposite outward magnetic flux along the centre of each coil indicated by the outlined arrows in FIG. 4. The actuator is therefore magnetically balanced both in its stable mode and during switching.

This is in contrast to the prior actuator disclosed in FIG. 1A to 1D of U.S. Pat. No. 3,772,540. In that case, the coils generate flux in the same directions and therefore the magnetic fields they create have a cumulative effect, leading to greater flux leakage.

As described above, during switching of an actuator of the form shown in the drawings, flux generated by the permanent magnet is deflected when the coils are energised, rather than opposed or reversed. Less electrical energy is therefore required to effect switching, making the actuator more efficient to operate. The permanent magnet is likely to be strongly magnetised and so the amount of energy needed to deflect its flux will be significantly less than that required to act in opposition to its field.

Figure 5:
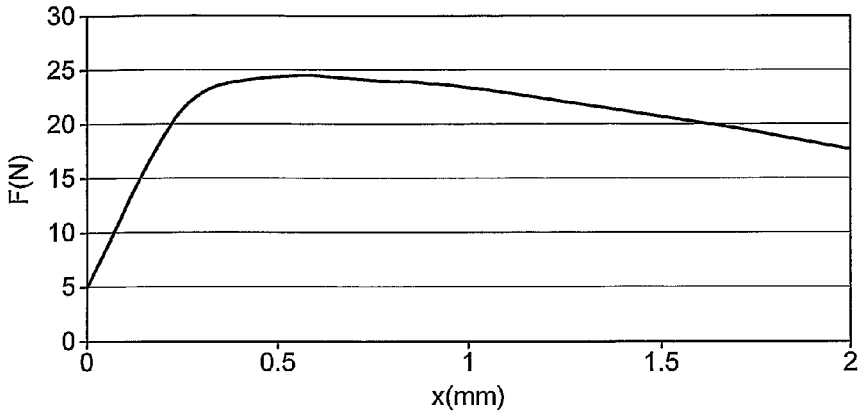
FIG. 5 is a plot of force against armature-container spacing.

The size of the gap 20 is carefully selected with reference to the size of the larger gap 22. The relationship between the size of this gap (x) and the resulting locking force (F) generated by an actuator embodying the invention is represented in the plot of FIG. 5. If no gap was present, the path of flux generated by permanent magnet 8 would be closed locally by the wall of the container 2. In this case there would only be a weak locking force urging the armature against coil core 12. If gap 22 were smaller than gap 20, then the magnetic flux generated by the permanent magnet would follow a path via coil core 12*b*, the magnetic container 2 and coil core 12*a*, again resulting in a lower locking force.

In some applications, for example in high pressure environments, it would be desirable to fill voids within the actuator with a non-compressible fluid or pressurized gas. Under these circumstances, the size of the gap 20 is also a significant factor as it determines the ease with which the fluid can pass around the armature as it moves from one stable position to another.

A practical benefit of the gap 20 is that it means that the surface finish of the armature and the facing surface of the magnetic container is not as critical as it would be if there was a sliding fit between these two components.

By way of illustration, the actuator which FIG. 5 relates has an armature travel distance of 3 mm, and a gap of 0.5 mm was found to be preferable.

Figure 6:
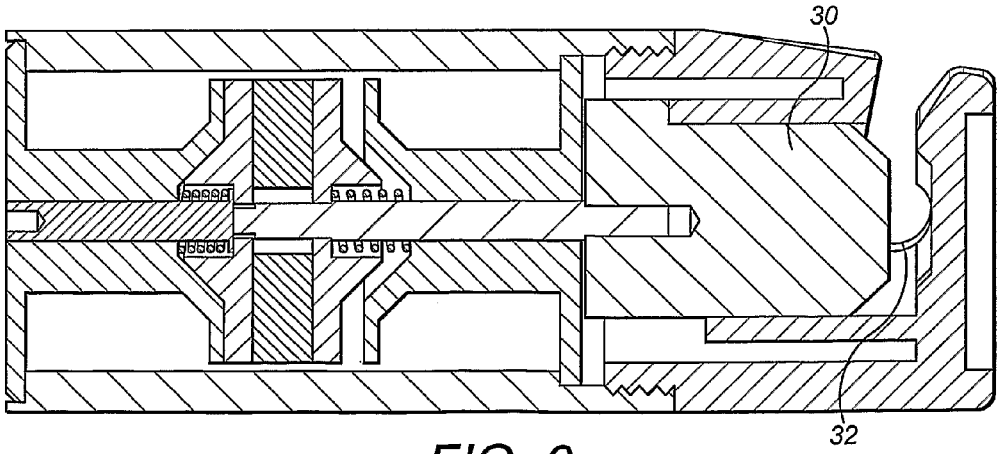
FIG. 6 is a side cross-sectional view of an actuator embodying the invention in combination with a tube clamping device.

FIG. 6 illustrates an actuator embodying the present invention in combination with a device for pinching a tube carrying a fluid. A head 30 is mounted on the end of push-pull rod 6. The fluid tube passes along a groove 32 defined by the valve. The valve is shown in its open position in FIG. 6. Operation of the actuator moves armature 10 to its right-hand stable position, moving head 30 to the right and thereby pinching a tube mounted in the valve to cut-off fluid flow through the tube. The locking force generated by the permanent magnet of the actuator serves to hold the valve in the closed position without requiring any power input. Application of a further current pulse to the coils of the actuator switches the valve back to its open position.

Figure 7:
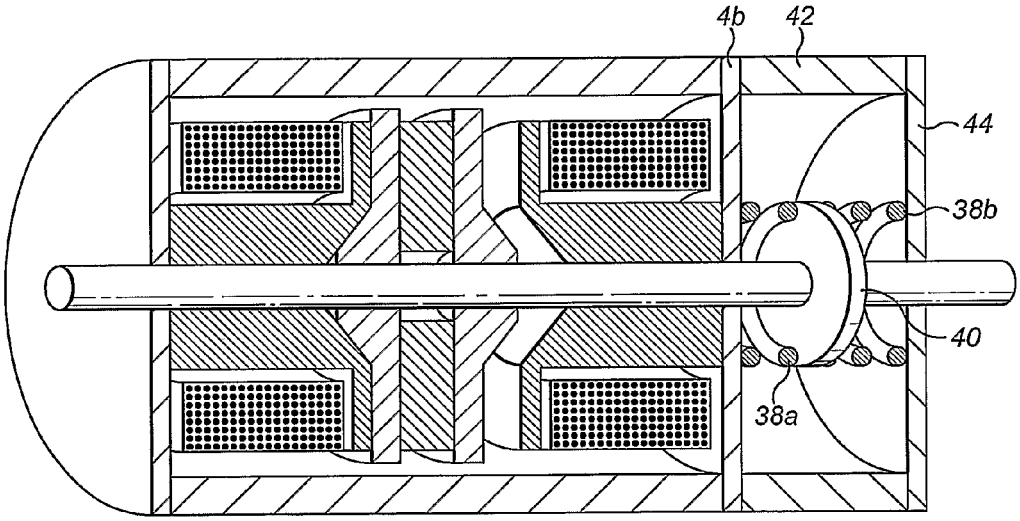
FIG. 7 is a perspective cross-sectional view of an actuator according to a further embodiment of the invention.

FIG. 7 illustrates a further embodiment of the invention in which springs 38*a*,38*b* are provided outside the actuator housing. A flange 40 is mounted on a portion of push-pull rod 6 which protrudes from the housing 2. Springs 38*a*,38*b* are located axially on either side of the flange. The springs and flange are provided within an enclosure 42. One of the springs is provided between end cap 4*b* of the actuator and the flange 40, whilst the other spring is provided between flange 40 and end wall 44 of the enclosure 42.

Whilst this configuration may be less compact than that shown in preceding Figures, the area of the mating faces between the coil cores and pole pieces of the actuator can be increased. Also, larger springs may be employed where a greater biasing force is required.

Figure 8:
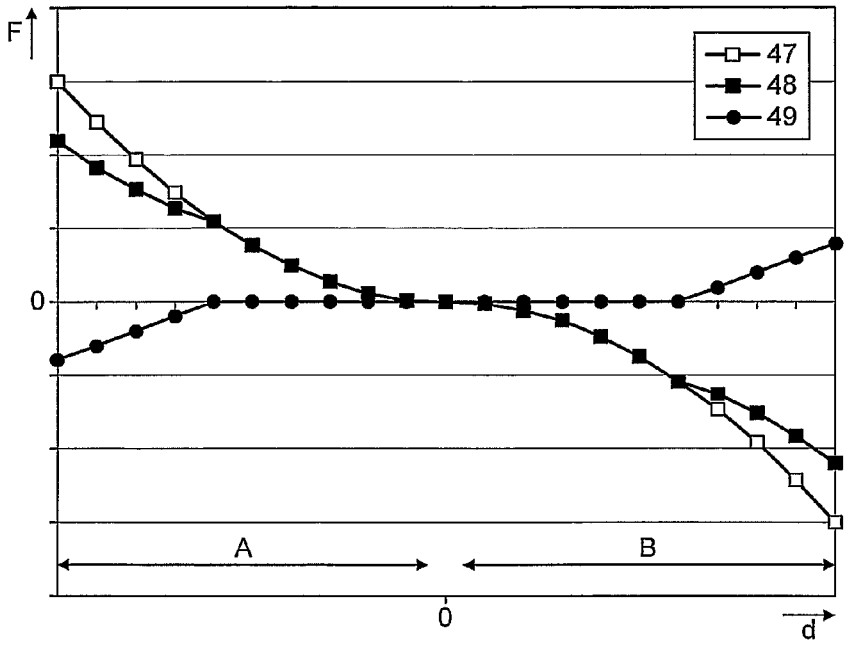
FIG. 8 is a schematic graph plotting the forces exerted on the actuator armature against its displacement for an actuator having a configuration of the form shown in FIG. 1.

In the graph of FIG. 8, the forces acting on the armature are plotted as a function of its axial displacement from a central position marked as zero on the horizontal axis. Plot 47 represents the passive magnetic forces, plot 49 the spring forces, and plot 48, the combination of these two. The "active" magnetic forces generated by energising the coils 14*a* and 14*b* are not shown. The portions of the armature's range of movement marked A and B in FIG. 8 represent regions in which the armature will be urged towards a respective stable rest position at each end of its travel, in the absence of other forces on the armature.

A further actuator configuration in accordance with the present invention will now be described with reference to FIGS. 9 to 11.

Springs 18*a* and 18*b* are located within the armature 10. The inner end of each spring bears against a collar 50 located axially on the rod 6 by a groove 52 defined by the rod. The outer end of each spring bears against a respective washer 54*a*, 54*b* which is slidably positioned around the rod 6.

Figure 10A:
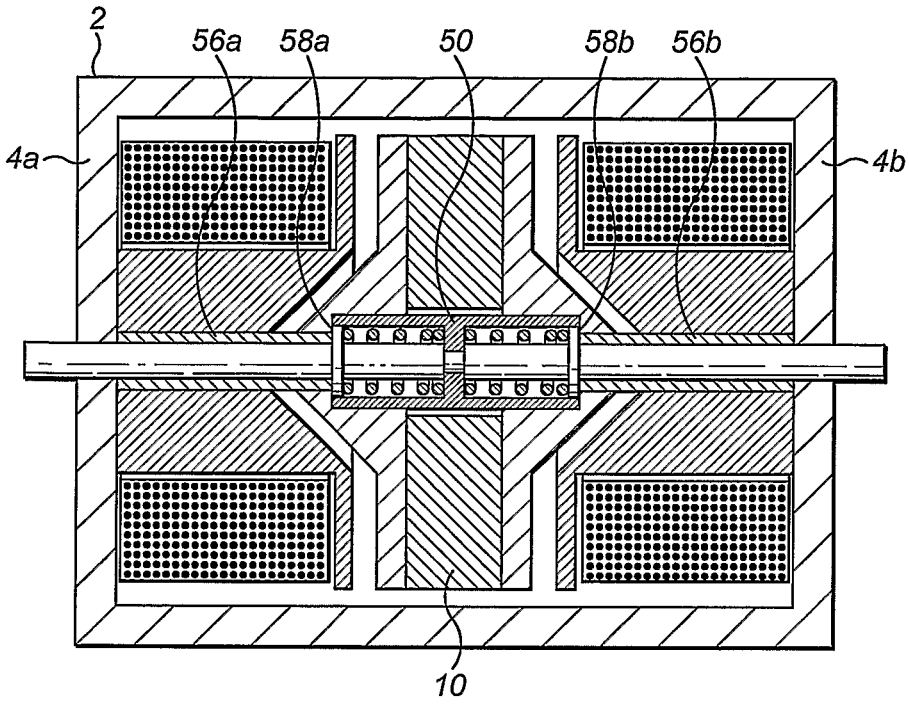
FIGS. 10A to 10C are side cross-sectional views of the actuator shown in FIG. 9 in three different stable positions.

When the armature is in a central position as depicted in FIG. 10A, the outer surface of each washer in the axial direction is in engagement with the inner end of a respective sleeve 56*a*, 56*b*, or other suitable abutment arrangement fixed in position relative to the container. This outer surface of each washer is also preferably in contact with an inwardly facing annular shoulder 58*a*, 58*b* defined by the armature. Each spring is preferably in a partially compressed state. This serves to better define this central position as a third stable position, as discussed further below.

Figure 10B:
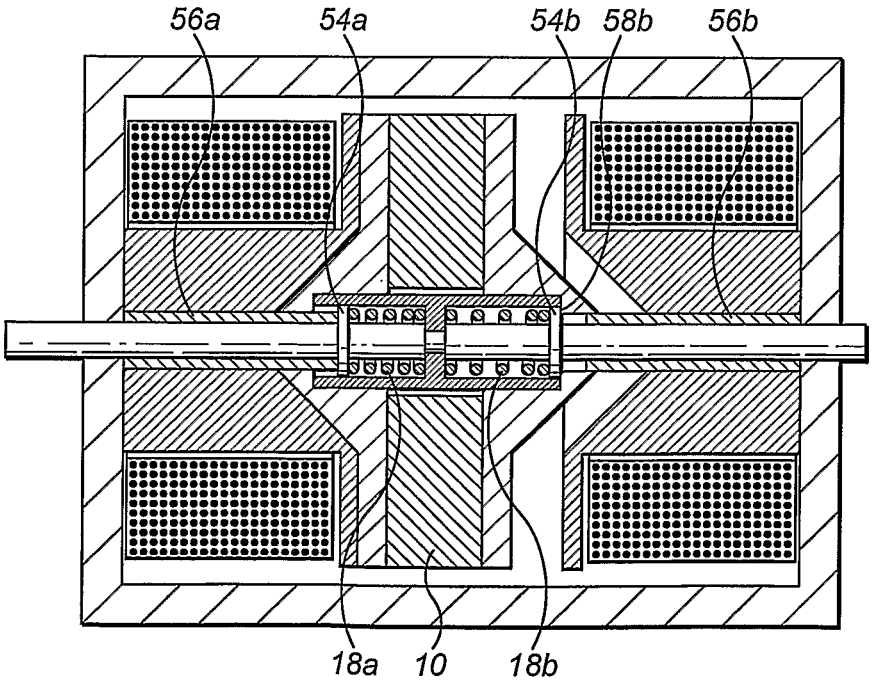
Figure 10C:
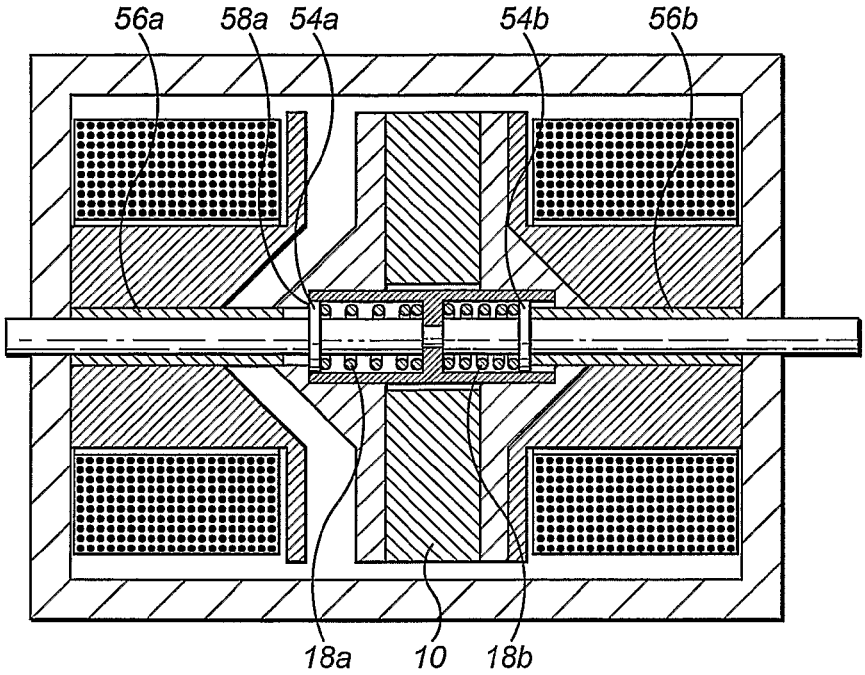

FIGS. 10A to 10C illustrate the three stable positions exhibited by this actuator configuration, namely a central position and the left and right hand ends of its travel. It can be seen that when the armature has moved into a stable position at either end of its range of travel (as in FIG. 10B or 10C), one of the springs has been compressed as a result of the respective sleeve 56*a*, 56*b* maintaining the corresponding washer (54*a* in FIGS. 10B and 54*b* in FIG. 10C) in the same position relative to the actuator housing. In contrast, the other washer has been lifted away from its respective sleeve by the corresponding shoulder (58*b* in FIG. 10B and 58*a* in FIG. 10C), with the extent of compression of the other spring consequently remaining unchanged. As a result, when the armature is moved back towards its central rest position, its travel is not impeded by having to compress the other spring. The spring that has been further compressed acts as an energy storage device and assists the movement of the actuator away from its end-of-travel position.

It will be appreciated that the resistance to movement of the armature out of its third, central rest position may be readily adjusted. For example this may be achieved by changing the spring constants of the springs, or by altering the extent to which the springs are compressed in this third stable position.

Figure 9:
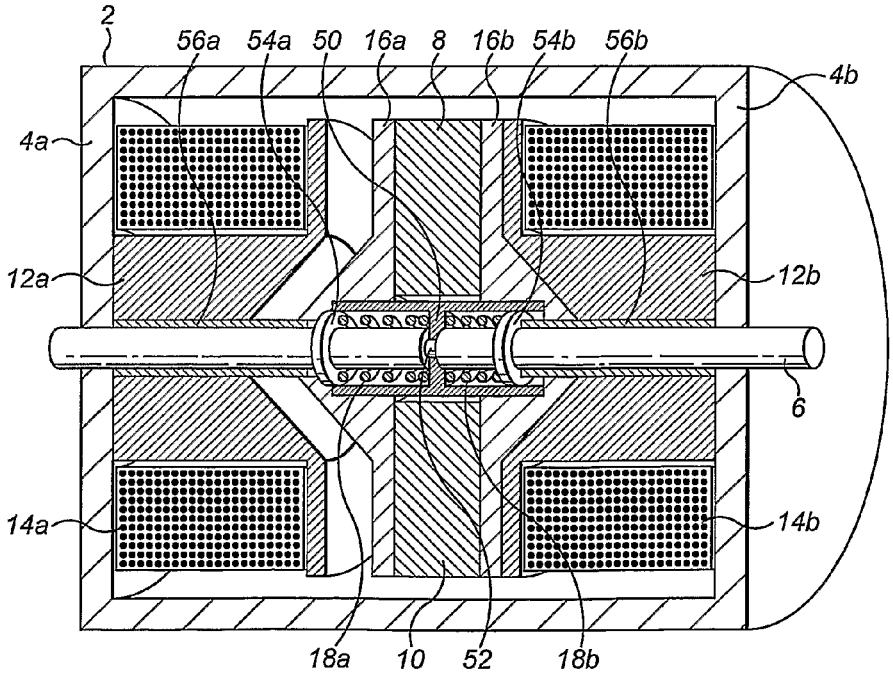
FIG. 9 is a side cross-sectional view of a further actuator configuration embodying the invention.
Figure 11:
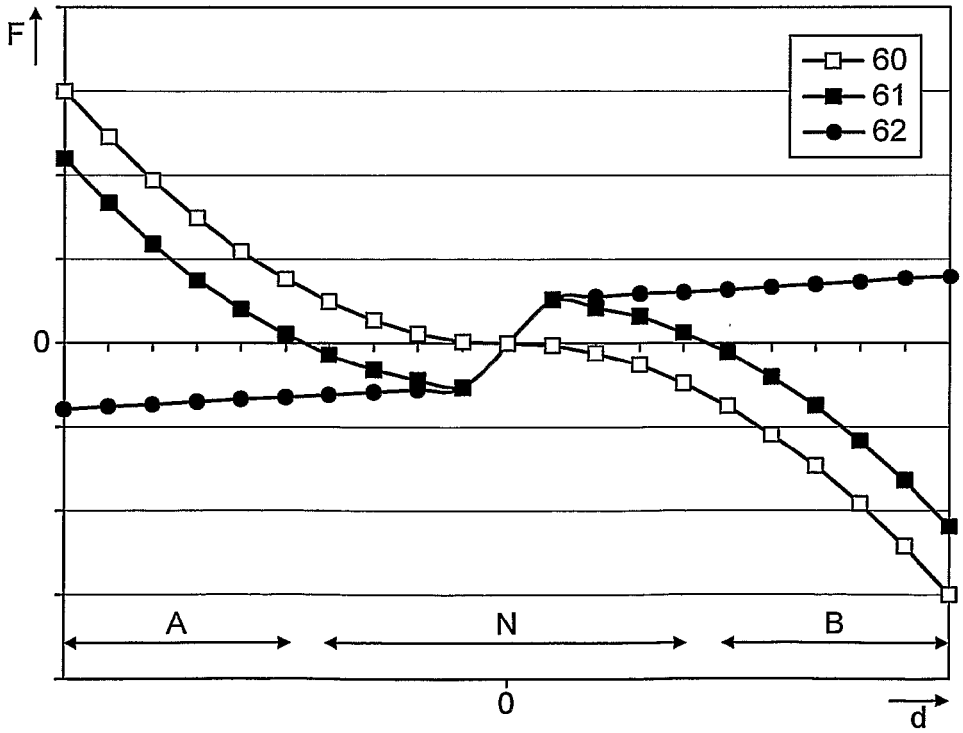
FIG. 11 is a schematic graph plotting the forces exerted on the actuator armature against its displacement for an actuator having a configuration of the form shown in FIG. 9.

FIG. 11 is a graph showing plots of the axial forces exerted on the armature in an embodiment having a configuration of the form shown in FIGS. 9 and 10. In this configuration having three stable positions, the range of travel of the armature is divided into three zones A, B, and N in the absence of any forces other than the spring forces and passive magnetic forces acting on the armature. With the armature within either of the end-of-travel zones A and B, it is urged by the resultant forces towards a respective end position. In the central zone N, it is urged towards a central stable rest position. Plot 60 represents the magnetic forces, plot 62 the spring forces, and plot 61 the combined effect of the magnetic and spring forces.

With the springs in a partially compressed state at the third, central stable position, the armature is more strongly biased towards this position. This can be seen from the steeper portion of the resultant force curve 61 passing through this central point in FIG. 11.

The embodiments illustrated herein by way of example include resilient devices which are compressed during operation of the actuator. It will be appreciated that the actuator concepts discussed may also be implemented using forces resulting from the extension of resilient devices.

The invention claimed is:

1. An electromagnetic actuator comprising:

an armature comprising a permanent magnet, wherein the armature is movable between first and second stable positions;

two electric coils disposed on opposing sides of the armature along its direction of movement, with their axes substantially aligned with said direction; and a magnetic flux container substantially surrounding the armature and the coils to substantially contain magnetic flux generated thereby and to substantially shield its interior from external magnetic flux, wherein in each stable position magnetic flux generated by the permanent magnet extends around a magnetic circuit path including the container so as to retain the armature in its stable position when the coils are de-energized, energizing the coils causes the armature to move from one stable position to the other, there is a third stable position between the first and second stable positions, and the actuator comprises a pair of resilient devices which are partially compressed or extended when the armature is in the third stable position, with the resilient devices arranged such that as the armature moves from the third stable position to one of the first and second stable positions, one of the pair of resilient devices is compressed or extended further, at least during a final portion of said movement, so as to urge the armature back towards the third stable position, and the degree of partial compression or extension of the other resilient device remains unchanged.

2. An actuator of claim 1, wherein the degree of partial compression or extension of each of the pair of resilient devices when the armature is in the third stable position is adjustable.

3. An actuator of claim 1, wherein each coil is wound round a core which forms part of the magnetic circuit formed when the armature is adjacent to the respective coil, and the actuator is configured such that when the armature is in either of the stable positions, the shortest path from the armature to the container is less than the shortest path from the armature to the more distant of the two coil cores.

4. An actuator of claim 3 configured such that when the armature is in either of the first and second stable positions, the shortest path from the armature to the container is less than the shortest path from the armature to the more distant of the two coil cores.

5. An actuator of claim 1, wherein the armature includes pole pieces on opposing sides of the permanent magnet along its direction of movement, and the actuator is configured such that, when the coils are energized, the path of magnetic flux through the pole piece closest to the corresponding coil core changes from a substantially axial orientation to a substantially radial orientation, and vice versa for the other pole piece.

6. An actuator of claim 5, wherein each pole piece defines a surface for engagement with a respective coil core, each coil core defines a complementary engagement surface, and each of said pole piece engagement surfaces includes a frustoconical portion.

7. An actuator of claim 1, wherein the permanent magnet is orientated with its North and South poles aligned with the direction of movement of the armature.

8. An actuator of claim 1, wherein each resilient device is disposed between a pole piece and a respective coil core.

9. An actuator of claim 1, wherein the magnetic flux container forms the housing of the actuator.

10. A method of operating an actuator of claim 1, comprising moving the armature from one stable position to the other by energizing the coils so as to generate axial magnetic flux through each coil in respective opposite directions.

* * * * *